US006418682B1

(12) United States Patent
Rice

(10) Patent No.: US 6,418,682 B1
(45) Date of Patent: Jul. 16, 2002

(54) NON-STRUCTURAL STEEL STUDS

(75) Inventor: John Rice, Concord (CA)

(73) Assignee: Bailey Metal Products Limited, Concord (CA)

( * ) Notice: Subject to any disclaimer, the term of this patent is extended or adjusted under 35 U.S.C. 154(b) by 0 days.

(21) Appl. No.: 09/641,943

(22) Filed: Aug. 21, 2000

(51) Int. Cl.[7] ..... E04B 2/56
(52) U.S. Cl. ..... 52/241; 52/733.3
(58) Field of Search ..... 52/656.1, 657, 52/241, 289, 283, 702, 668, 669, 733.3, 690, 696; 403/262, 263; 29/897.31, 897.312, 897.32, 897.15

(56) References Cited

U.S. PATENT DOCUMENTS 2,058,386 A * 10/1936 Parsons ..... 52/241
4,001,993 A * 1/1977 Daniels ..... 52/733.3
4,294,052 A * 10/1981 Blauer ..... 52/690
5,295,754 A * 3/1994 Kato ..... 52/702
5,440,848 A * 8/1995 Deffet ..... 52/733.3
5,596,859 A * 1/1997 Horton et al. ..... 52/733.3

* cited by examiner

*Primary Examiner*—Michael Safavi

(57) ABSTRACT

A nonload bearing partition wall including spaced apart wood top and bottom plates and a plurality of metal studs bridging the top and bottom plates. The metal studs have U-shaped rectangular cross section with two parallel spaced apart side walls and a central web bridging the side walls and connected to one edge of each of the side walls. The central web has an extension on each end thereof. The extensions are contained within the slots of the top and bottom plates the slots of the top and bottom plates having a depth less than one half the height of the edge of the top and bottom plates. One of the sidewalls has a first extension extending from either end over and attached to the edge of the top and bottom plates. The second side wall has second extensions extending from either end perpendicularly inwardly from the side wall to lie over and be attached to the inner face of the top and bottom plates.

3 Claims, 3 Drawing Sheets

FIG. 1.
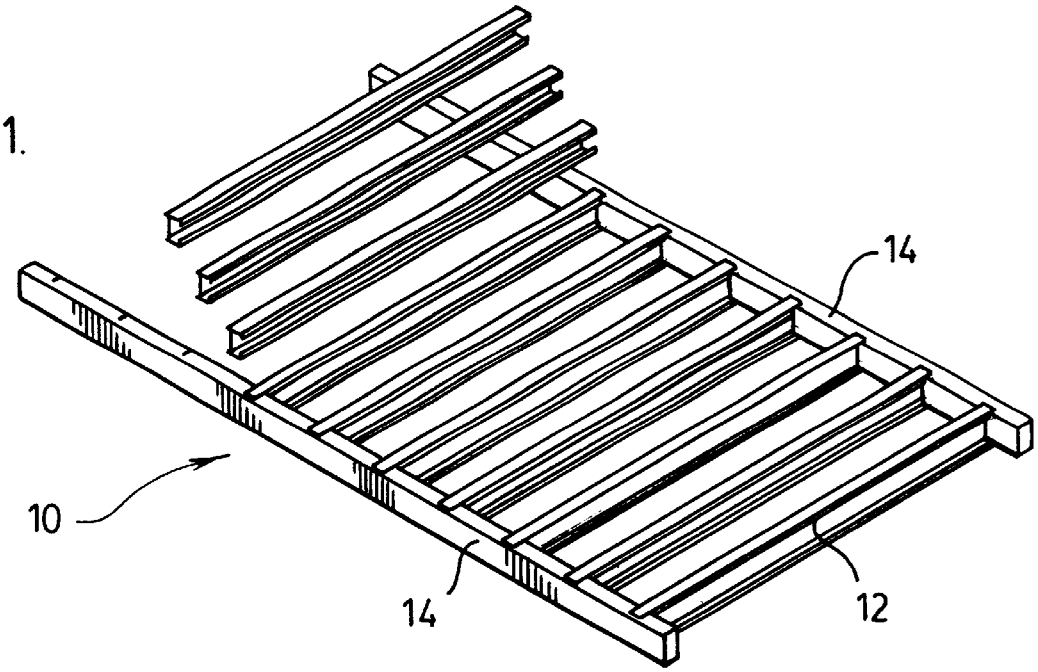
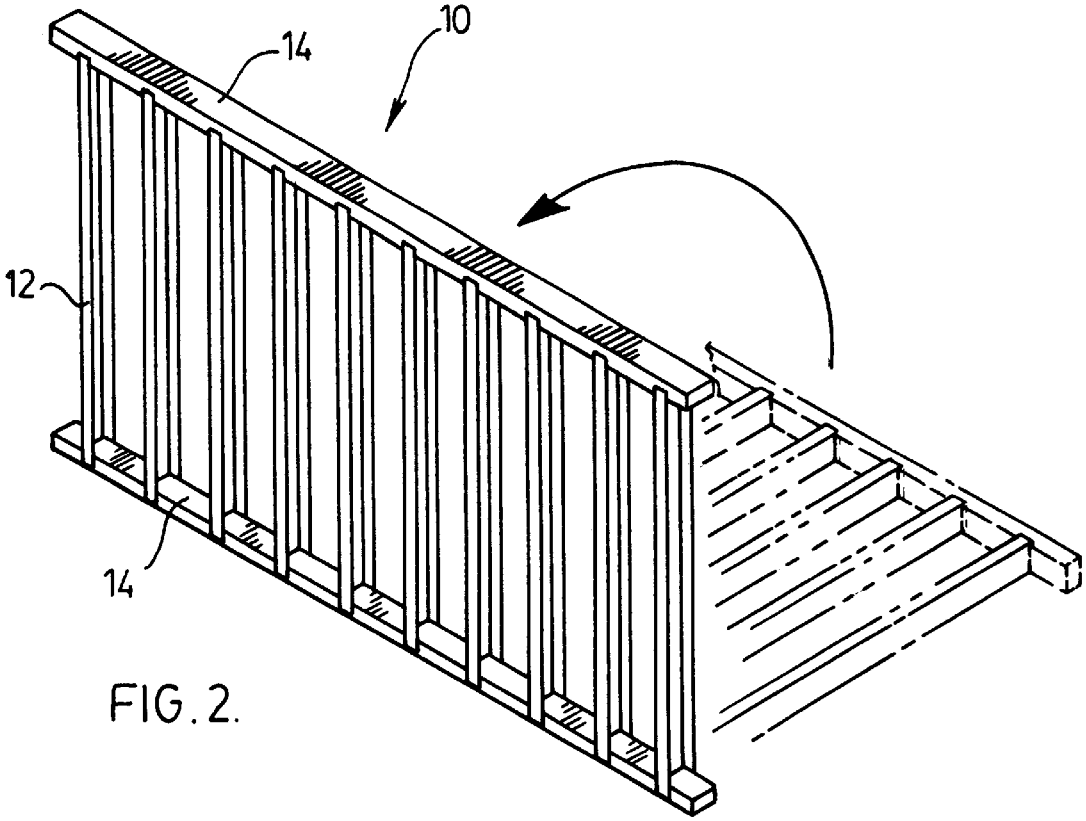
FIG. 2.

NON-STRUCTURAL STEEL STUDS

FIELD OF THE INVENTION

The present invention relates to a metal stud for use in a partition wall having wood plates and the metal studs. The invention also relates to a non-load bearing partition wall constructed of wood plates and the metal studs

BACKGROUND OF THE INVENTION

It is the common practice in residential and much commercial buildings to separate the various rooms by partition walls to define the spaces of the building. Such partition walls are generally nonload bearing and have in the past been constructed of wood members including top and bottom plates and bridging studs. The use of wood members has its shortcomings. The supply of lumber is getting scarcer and the cost has increased during recent years. In addition wood can warp and go out of shape when it becomes wet as well as beings acceptable to attack by vermin of various kinds.

In recent years partition walls framed with sheet metal members have been employed. The use of sheet metal members provides advantages of dimensional stability, ease of manufacture, and conservation of natural resources among others. However the use of sheet metal framing members has not gained widespread acceptance for various reasons. Load bearing walls constructed of sheet metal members are not generally less expensive than comparable walls framed with wood members. In addition the use of metal framing members requires specialized fastening systems other than the nails which are typically utilized with wood members. While this does not generally present a problem during the framing of the structure the finish carpentry including attaching of trim materials is a problem as there is no proper supporting surface for nailing of the trim member.

There have been attempts to overcome, the above disadvantages by utilizing a composite wall having wood top and bottom plates and sheet metal studs bridging the top and bottom plates. Examples of such prior art structures are given in U.S. Pat. Nos. 4,001,993, 5,440,848, and 5,596,859.

U.S. Pat. No. 4,001,993 to Daniels describes a sheet metal stud having a shape and dimension corresponding substantially to wood studs and a cross-sectional configuration providing for rigidity and dimensional stability. The metal studs are utilized with wood top and bottom plates to which a sheet of particleboard has been attached to the inner surface. The ends of the stud penetrate the particleboard to protect the surface of the wood plates. The studs are provided with extensions on either side for nailing of the stud to the plates. However the metal stud is expensive to manufacture and it is not easy for the framers to construct partition walls utilizing the metal stud as extensions on both sides must lie over the edges of the top and bottom plates.

U.S. Pat. No. 5,440,848 describes metal studs to replace vertical wood studs for use of framing of walls or partitions. The ends of the metal studs are provided with a flange on both ends of only one side of the metal stud to lie over one edge of the top and bottom plate and a flange on the web to lie over the inner surface of the top and bottom plate. While the stud is simple to install in partition walls it does not have great dimensional stability even when attached to the plates.

U.S. Pat. No. 5,596,859 describes a metal wall stud having pre-punched nail or screw holes and pre-punched passageways for electrical or plumbing facilities. The metal stud is provided with integral tabs extending beyond the ends of the stud walls which are foldable to provide connections to wood plates or metal wall stud purlins in the construction framing. The web of the stud is provided with split tabs to provide lateral stabilization, greater uplift loads, and the capability of being load bearing.

There still remains a need for a metal wall stud which usable with wood top and bottom plates to provide for an inexpensive and easy to assemble nonload bearing partition wall.

SUMMARY OF THE INVENTION

The present invention is directed to a nonload bearing partition wall comprising spaced apart wood top and bottom plates and a plurality of metal studs bridging the top and bottom plates. The metal studs have U-shaped rectangular cross section with two parallel spaced apart side walls and a central web bridging the side walls and connected to one edge of each of the side walls. The central web has an extension on each end thereof. The extensions are contained within the slots of the top and bottom plates the slots of the top and bottom plates having a depth less than one half the height of the edge of the top and bottom plates. One of the sidewalls has a first extension extending from either end over and attached to the edge of the top and bottom plates. The second side wall has second extensions extending from either end perpendicularly inwardly from the side wall to lie over and be attached to the inner face of the top and bottom plates.

BRIEF DESCRIPTION OF THE DRAWINGS

Preferred embodiments of the present invention are illustrated in the attached drawings in which FIG. 1 is a perspective view of a wall according to the present invention in the process of being constructed;

FIG. 2 is a perspective view of the wall of FIG. 1 in the process of being installed;

DETAILED DESCRIPTION OF THE PREFERRED EMBODIMENTS

Figure 3:
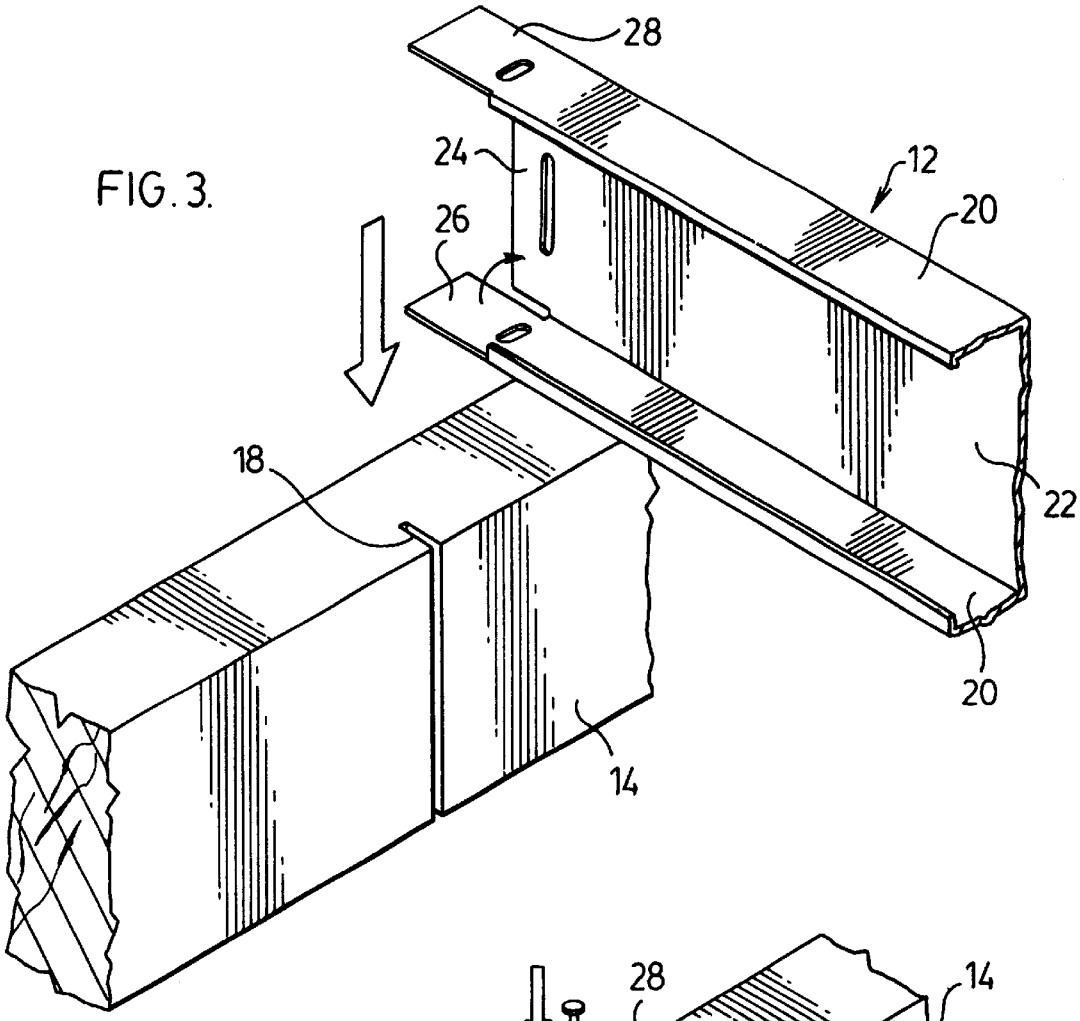
FIG. 3 is a perspective view of the stud being inserted into the slot of the plate.

The present invention is directed to a nonload bearing partition wall 10 constructed utilizing metal studs 12 and wood top and bottom plates 14 as well as to the metal stud 12 utilized in the partition wall 10. The partition wall 10 has wood top and bottom plates 14 that are bridged by the parallel spaced apart metal studs 12. The spacing between the metal studs 12 is that typically utilized in construction of partition walls generally at 16 inches on center although other spacing such as 24 inches on center may be utilized. To aid in the location of the studs 12 the top and bottom plates 14 are provided with slots 18 cut into and across the inner surface of the top and bottom plates 14. The slots 18 are spaced apart 16 inches to provide for the proper spacing of the metal studs 12. The slots have a depth less than ½ the depth of the top or bottom plates 14.

The metal stud 12 has a generally U-shaped rectangular cross section with two parallel spaced apart side walls 20 and a central web 22 bridging the side walls 20 and connected to one edge of each of the side walls 20. The central web 22 is provided with an extension 24 at either end thereof, the extension 24 being capable of fitting within the slot 18 of the top and bottom plate 14. One of the side walls 20 is provided with a first extension 26 at either end thereof and the second side wall 20 is provided with a second extension 28 at either end thereof. The extensions 24, 26, and 28 are formed from the end of the stud by removing material to form the three extending tongues 24, 26 and 28. The material of the stud forming the extending lips on the sidewalls as well as a material in the bend line between the sidewalls and the central web is removed. This provides the extensions 24, 26 and 28 as planar extending tongues extending from the ends of the sidewalls 20 and central web 22. In order to make the bending of the extensions 24, 26 or 28 easier slots 30 and 32 are cut into the extensions 24, 26 and 28 along the bend lines.

Figure 4:
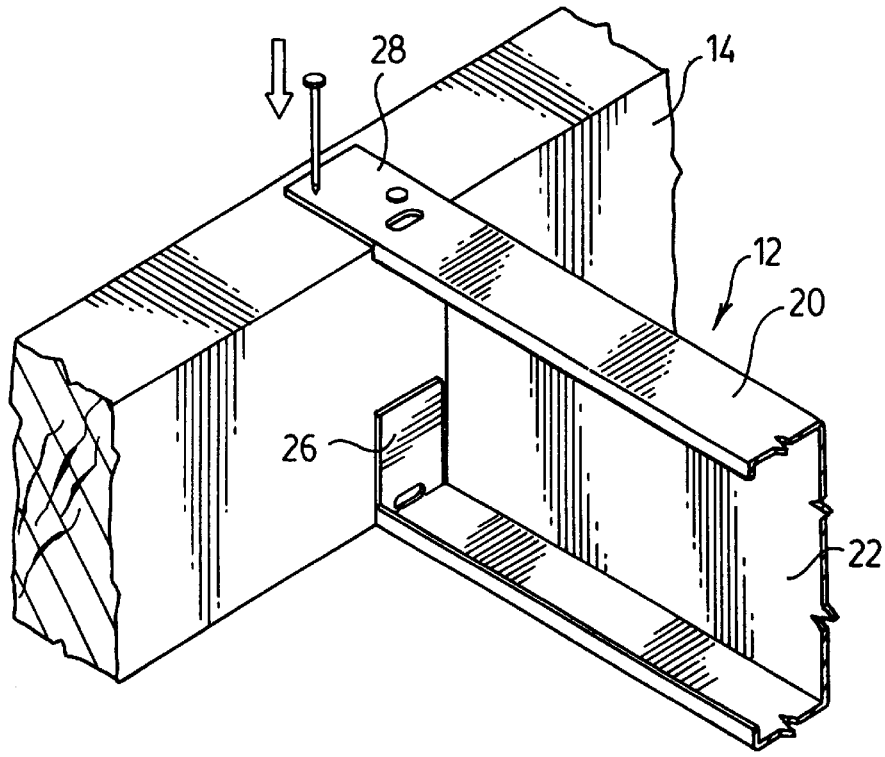
FIG. 4 is a perspective view of the first extension of the stud being attached to the plate.
Figure 5:
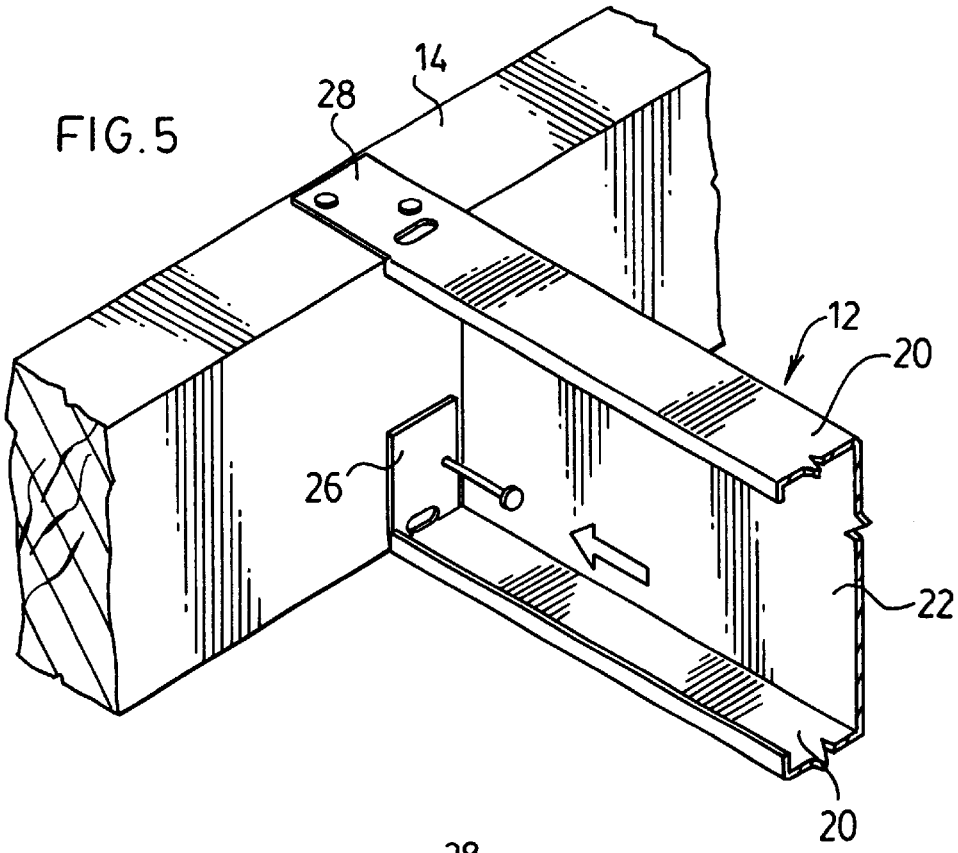
FIG. 5 is a perspective view of the second extension of the stud being attached to the plate.

FIGS. 3 to 5 illustrate the process of attaching the metal studs 12 to the top and bottom plates 14 to form the nonload bearing partition wall 10. The top and bottom plates 14 are laid on edge spaced apart the height of the partition wall 10 with their innerfaces containing the slots 18 facing one another. The first extensions 26 on the sidewalls 20 at either end of the stud 12 are bent inwardly perpendicular to the sidewall 20. The stud 12 is then placed into its bridging position between the top and bottom plates 14 by sliding the extension 24 into the slot 18 until the second extension 28 of the side wall 20 rest against the edges of the top and bottom plates 14. The first extensions 28 rest against the inner face of the top or bottom plates 14 and the web extension 24 is contained within the slot 18. The studs 12 are then attached to the top and bottom plates 14 by nailing through the first and second extensions 26 and 28 into the top and bottom plates 14. The other studs 12 are installed in a similar manner to form the completed nonload bearing partition wall 10. Once the wall 10 is constructed it is lifted off the floor into position and attached in the typical manner by nailing through the top and bottom plates 14.

Figure 6:
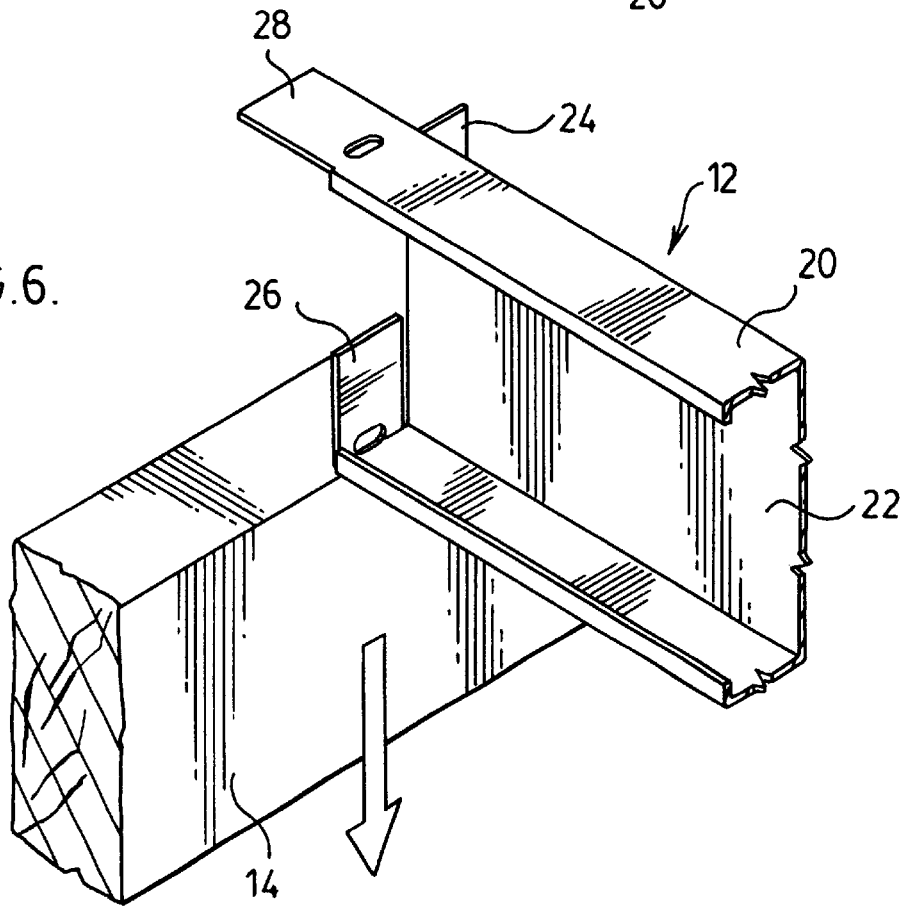
FIG. 6 as a perspective view of the stud being attached to the plate away from a slot.

There may be situations where it is necessary to install a stud 12 in a location where there is no precut slot 18. The situations would typically arise where a stud is required to support a fixture which would be attached to the wall. In this situation the installer would have to options. The first option would be for them to manually cut slots in the top and bottom plate in the position in which the stud is to be installed. Once the slots have been cut the stud 12 would be installed in the usual manner as described above. The second option as illustrated in FIG. 6 would be to bend the web extension 24 perpendicularly outwardly from the web and then the first extension 26 perpendicularly in the manner described above. When the stud 12 is placed between the top and bottom plates 14 both the first extension 26 and the web extension 24 lie against the inner surface of the top and bottom plate 14 while the second extension 28 lies against the edge of the top or bottom plate 14. The stud is attached to the top and bottom plates 14 by nailing through the first extension 26 and second extension 28 in the manner described above as well as through the web extension 24 into the top and bottom plate.

As finish carpenters prefer to be able to install wood trim by nailing into a wood supporting structure it is preferred if openings such as doors or windows which will be trimmed by the finish carpenter be framed in the wall utilizing wood studs.

The partition wall of the present invention as well as the studs utilized in constructing the partition wall result in a partition wall which is easier to produce for the framers onsite than traditional all wood partition walls. As the metal studs do not warp or bend it is not necessary for the framers to check the studs prior to their being utilized in the partition wall. In addition as the top and bottom plates are preferably provided with the slots precut, the spacing of the studs in the partition walls are predetermined so it is not necessary for the framer to lay out the stud spacing on the top and bottom plate prior to the construction of the wall. Rather the framer merely has to space apart the top and bottom plates, bend the extensions on the studs, and drop the studs into place. Once the studs are in place the studs are attached to the plate preferably using an air hammer [rare state or in] and the wall lifted [top] up and placed into position. To further speed up the process, the studs may be supplied with the first extensions pre-bent.

The metal studs of the present invention also help to reduce other costs associated with construction. Due to the U-shaping of the stud, the studs may be nested for shipping, reducing the shipping volume by half compared to an equivalent number of woods. Additionally, the metal stud weighs less than wood studs, thus reducing the total weight required for shipping.

The embodiments of the invention in which an exclusive property or privilege is claimed are as follows:

1. A nonload bearing partition wall comprising spaced apart wood top and bottom plates having an inner face and opposing edges and a plurality of metal studs bridging the top and bottom plates, the metal studs having a U-shaped rectangular cross section with two parallel spaced apart sidewalls and a central web bridging the sidewalls and connected to one edge of each of the sidewalls, the central web having an extension on each end thereof, the extension contained within slots provided in the inner surface of the top and bottom plates, one of the sidewalls having first extensions extending from either end of the sidewalls over an edge of the top and bottom plates and attached thereto, the second sidewall having second extensions extending from either end perpendicularly inwardly from the sidewall to lie over and be attached to the inner face of the top and bottom plates.

2. A nonload bearing partition wall according to claim 1 wherein the slots of the top and bottom plates have a depth less than one half the height of the edge of the top and bottom plates.

3. A nonload bearing partition wall according to claim 2 wherein the slots of the top and bottom plates are spaced 16 inches apart.

* * * * *